US011187501B2

(12) United States Patent
Waswo

(10) Patent No.: US 11,187,501 B2
(45) Date of Patent: Nov. 30, 2021

(54) GUN DISABLING MOCK AMMUNITION

(71) Applicant: Beau Waswo, Quechee, VT (US)

(72) Inventor: Beau Waswo, Quechee, VT (US)

( * ) Notice: Subject to any disclaimer, the term of this patent is extended or adjusted under 35 U.S.C. 154(b) by 93 days.

(21) Appl. No.: 16/299,136

(22) Filed: Mar. 12, 2019

(65) Prior Publication Data

US 2019/0301842 A1 Oct. 3, 2019

Related U.S. Application Data

(60) Provisional application No. 62/650,415, filed on Mar. 30, 2018.

(51) Int. Cl.
*F42B 5/16* (2006.01)
*F42B 5/145* (2006.01)
*F42B 5/02* (2006.01)

(52) U.S. Cl.
CPC ..... *F42B 5/145* (2013.01); *F42B 5/025* (2013.01); *F42B 5/16* (2013.01)

(58) Field of Classification Search
CPC ..... F42B 5/145; F42B 5/025; F42B 5/181; F42B 5/16; F42B 8/04
USPC ..... 102/470
See application file for complete search history.

(56) References Cited

U.S. PATENT DOCUMENTS 3,352,238 A * 11/1967 Spragg ..... F42B 5/145 102/370
3,546,997 A * 12/1970 Biehl ..... F02K 9/97 86/1.1
3,794,535 A * 2/1974 Bertrand et al. ..... C06B 25/24 149/3
4,555,272 A * 11/1985 Ashok ..... F42B 5/28 148/553
5,698,812 A * 12/1997 Song ..... F42B 12/44 102/283
5,841,063 A * 11/1998 Hellkvist ..... F42B 39/20 102/481
6,408,759 B1 * 6/2002 Ewick ..... C06C 7/00 102/202.5
6,722,283 B1 * 4/2004 Dindl ..... F42B 5/145 102/370
6,971,314 B2 * 12/2005 Maguire ..... F42B 3/00 102/401

(Continued)

*Primary Examiner* — Joshua E Freeman
(74) *Attorney, Agent, or Firm* — Wilmer Cutler Pickering Hale and Dorr LLP

(57) ABSTRACT

The Gun Disabling Mock Ammunition is a device made to the same outward dimensional specifications and aesthetic characteristic as actual firearm ammunition; however, when attempted to be fired from a firearm, the effect is a non-hazardous, exothermic reaction taking place within the ammunition cartridge, producing heat substantial enough to bond the Gun Disabling Mock Ammunition to the inside of the chamber of the firearm, rendering the firearm immediately disabled and the chamber destroyed. This is accomplished while posing no risk of injury to the user or bystanders. The components of the Gun Disabling Mock Ammunition are non-toxic, non-hazardous, and chemically stable. Through use of the Gun Disabling Mock Ammunition, a reduction of deaths, injuries and crimes resulting from the intentional and unintentional use and access of unsecured legal, illegal and insurgent-force firearms can be achieved.

20 Claims, 3 Drawing Sheets

(56) References Cited

U.S. PATENT DOCUMENTS

| | | | | |
|---|---|---|---|---|
| 7,150,409 | B2 * | 12/2006 | Gonnelli | A61M 5/30 239/1 |
| 8,172,963 | B2 * | 5/2012 | Schroder | C06C 5/04 149/108.2 |
| 8,887,638 | B1 * | 11/2014 | Calvert | F42B 5/00 102/430 |
| 9,052,175 | B1 * | 6/2015 | Calvert | F42B 5/145 |
| 9,618,293 | B1 * | 4/2017 | Moy | F41A 35/00 |
| 9,714,803 | B2 * | 7/2017 | Giebel | F41A 17/74 |
| 2010/0175867 | A1 * | 7/2010 | Wright | E21B 23/04 166/57 |
| 2010/0275804 | A1 * | 11/2010 | Trivette | F42B 7/06 102/448 |
| 2012/0009424 | A1 * | 1/2012 | Jelliss | B01J 13/14 428/403 |
| 2012/0145830 | A1 * | 6/2012 | Stevenson | F42B 12/44 244/137.1 |
| 2012/0285345 | A1 * | 11/2012 | Swingley | F42B 33/00 102/464 |
| 2016/0018199 | A1 * | 1/2016 | Nemec | F42B 12/74 102/439 |
| 2017/0030690 | A1 * | 2/2017 | Viggiano | F42C 19/0807 |
| 2017/0030692 | A1 * | 2/2017 | Drobockyi | F42B 33/001 |
| 2019/0033045 | A1 * | 1/2019 | Mohler | F42B 5/025 |

* cited by examiner

GUN DISABLING MOCK AMMUNITION

CROSS-REFERENCE TO RELATED APPLICATIONS

This application claims the benefit of U.S. Provisional Application No. 62/650,415, filed Mar. 30, 2018.

STATEMENT REGARDING FEDERALLY SPONSORED RESEARCH OR DEVELOPMENT

Not Applicable

FIELD OF THE INVENTION

This invention relates to devices and methods for the disabling of firearms, and more specifically to mock ammunition which renders a firearm inoperable by non-hazardous, non-harmful incendiary means.

BACKGROUND OF THE INVENTION

Gun violence is a prevalent issue that affects every level of society in almost every country of the world and has a multitude of contributing factors which have made the effective prevention of intentional or unintentional gun violence currently and historically unachievable.

In the realm of Law Enforcement, officers are at risk of being killed by their own firearm if it is taken during an altercation. This occurs many times each year in the United States.

The presence of firearms can act as a catalyst for criminal behavior such as in domestic abuse situations where the aggressor possesses and threatens use of a firearm. Historically, there have been no effective controls on firearms possession in regards to a person who discretely threatens their family members with gun violence and already legally owns a firearm.

Guns play a dominant role in the suicide statistics that plague our nation. There is not much that one can do if they suspect a person wishes to harm themself with a firearm that they legally possess—but do not wish to relinquish.

A problem also exists where people keep loaded firearms hidden in their home, vehicle or place of work for quick and functional access. This results in many unintentional deaths and injuries being the result of children finding firearms hidden around the home or vehicle.

Weapons acquired by law enforcement through "buy-back programs" or confiscation have absolutely no guarantee that they will not be resold, stolen, or circumvented back onto the street. A safe, user friendly, immediately effective and easily implemented way to ensure a firearm is made inoperable by the irreparable damage of internal components is currently not utilized.

Places where it is known that many firearms are kept, such as gun shops, police departments or police officers' vehicles are targets for gun thefts; according to the ATF Data and Statistics, approximately 12,000 firearms were stolen from gun dealers in 2017 and hundreds of guns are stolen from police officers' cars and homes each year.

People often keep firearms "hidden" in their vehicles, rather than their homes; currently, this results in thousands of firearm thefts each year.

All of the above mentioned scenarios present the risk of gun violence by those people who inflict such violence on others and also by those who wish to do harm unto themselves. There is no easy and effective way to remove these pre-existing weapons from such dangerous circumstances or from useful circulation, which does not pose serious harm to bystanders, and especially if individuals are unwilling to voluntarily surrender them.

Currently, methods for disabling a firearm using sabotage ammunition involves the use of some form of explosive charge or intensely violent exothermic reaction to perform that goal. These methods pose serious harm to the firearm user and bystanders. In most cases, the imitation ammunition is intended to kill the user or bystanders. In war-torn regions of the world, the end user of exploding sabotage ammunition may be in the presence of innocent people and children, or may be a child themself. Current forms of sabotage ammunition cannot be used to address the issue of proliferating illegal firearms in the United States, or on any civilian population plagued with gun violence. Likewise, if one wished to keep a handgun safe from unauthorized use in their home—there would be no recourse if a child were to be blown-up by exploding ammunition.

Current forms of sabotage ammunition contain materials that the enemy can exploit, such as White Phosphorus or C-4 explosive. Forms of sabotage ammunition which employ high explosives or restricted chemicals, if distinguished and disassembled, can be stockpiled by the enemy and the restricted materials used to construct other explosive devices or weapons.

SUMMARY OF THE INVENTION

The Gun Disabling Mock Ammunition is a form of sabotage ammunition and is made to the same outward dimensional specifications and aesthetic characteristic as an actual firearm ammunition cartridge; however, when attempted to be fired from a firearm, the effect is a non-hazardous, non-violent reaction, producing heat substantial enough to bond parts of the Mock Bullet Projectile to the inside of the firearm chamber. This action renders the firearm immediately inoperable and irreparable unless the barrel and chamber are professionally replaced. A cartridge is also commonly referred to as a "round" or a "shell" and may have varied shapes, sizes and outward appearances.

The Gun Disabling Mock Ammunition performs the task of rendering a firearm inoperable through the exothermic reaction of a fuel and metal oxide mixture, and sometimes aided by modifications made to the shell casing, which will be discussed later. Depending on the specific application, this mixture is comprised of at least one fuel and one metal oxide. This mixture is a derivative of that which is commonly known as Thermite and for ease of explanation will be referred to simply as "Thermite" or "Thermite Mixture" throughout this description. Examples of metal oxides and fuels that could be used to make the Thermite Mixture are that of Copper Oxide, Iron Oxide, Aluminum, and Magnesium; however, there are a multitude of fuels and metal oxide Thermite Mixtures that are known to produce substantial exothermic reactions. The Thermite Mixture reaction is initiated by an "Ignition Mixture" which is ignited by the detonation of the standard percussion primer cap when struck by the firing pin of the firearm in which the Gun Disabling Mock Ammunition is loaded. The Ignition Mix is comprised of a fuel and metal oxide mixture with similar ingredients to that of the Thermite Mixture, but in a finer powder form and in a ratio of fuel and oxide such that it is much more easily ignitable than the Thermite Mixture.

Depending on the specific Thermite Mixture recipe used and the available space presented by the caliber of ammunition being replicated—shell casing modifications may be employed to ensure that the heat energy produced by the Thermite reaction is able to melt through the shell casing wall and cause bonding to occur with the walls of the chamber of the given firearm. The preferred modification to the shell casing is the intentional reduction of wall thickness in local areas by removing material from the inside surface of the shell casing wall. These thinly walled areas are unnoticeable from the exterior of the shell casing. Shell casings can be made with this thin-walled feature included in the manufacturing process by using specially designed dies; alternatively, the thin-walled feature can be added as a retrofit modification to existing ammunition shell casings by using a cutting tool such as an end-mill or small grinding wheel to remove material from the inside walls of the shell casing. An alternative modification to the shell casing is to produce the shell casing from an alternative metal or alloy with a melting point lower than that of normal brass or steel shell casings, in order to facilitate the bonding of material to the chamber of the firearm.

As the Background of the invention suggests—there are a multitude of applications where the Gun Disabling Mock Ammunition is may be used. The application of the invention may be easily summarized in two respects; the Gun Disabling Mock Ammunition may be employed wherever one wishes to keep a legal firearm safe from use by unintended person(s) and also that the Gun Disabling Mock Ammunition may be used wherever one wishes to covertly remove firearms from useful circulation within a targeted area or group.

In the latter respect, the scope of use may include law enforcement targeting a particular city or community where gun crime is prevalent or a specific organized gang, to which the covert introduction of Gun Disabling Mock Ammunition, lacking any identifiable markers and made to look identical to normal ammunition, would be used in order to reduce the quantity of illegal firearms present within that community or group. A similar application in which the Gun Disabling Mock Ammunition may be used to covertly disable firearms could include use by the Military. For example, if the Gun Disabling Mock Ammunition were to be distributed behind enemy lines prior to, or after, a planned military invasion—the number of weapons available to rebels or insurgent groups is greatly reduced. Distribution techniques vary by circumstance. The Gun Disabling Mock Ammunition can save the lives of domestic citizens in crime-plagued areas and can save the lives of military servicemen abroad.

Another opportunity for the Gun Disabling Mock Ammunition to save lives through the disabling of firearms is through implementation by those who wish to keep a firearm safe from use by unintended person(s). This includes individuals who are responsible for the safekeeping of loaded and unloaded firearms, such as police officers, gun shop owners, and private citizens who keep loaded firearms unlocked and available for immediate use around the home. A police officer may carry a sidearm for both defensive and offensive purposes, but when confronted with close quarters physical altercations, that firearm can be taken from the officer and used against him or her. Every year multiple officers are killed by having their own guns wrestled away from their possession by a criminal and used against them. Within the scope of securing a legal firearm, the Mock Ammunition may be produced to possess an identifiable marker. Such a marker can be printed on the exterior of the shell casing; the primer or shell casing can be produced with a color that is nonstandard, or a unique embossment on the bottom of the shell casing can be used as a visual marker to allow the user to identify the Gun Disabling Ammunition from normal ammunition. By intentionally loading the first round of their magazine with a Gun Disabling Mock Ammunition, if someone takes an officer's gun and attempts to fire it, the Gun Disabling Mock Ammunition will immediately disable the firearm and leave the criminal with a useless weapon. However—if the officer needs to use their sidearm, they will know to eject the first round as they raise their weapon to aim, therefore avoiding the Gun Disabling Mock Ammunition they previously loaded in their magazine. In the instance of private citizens who keep loaded guns in hidden but accessible places—the risk of a child or criminal finding the loaded gun is very real. The same implementation tactic of making the first round in the magazine a Gun Disabling Mock Ammunition can be used, therefore denying a criminal a useful stolen gun or saving a child from accidently shooting themself or accidentally shooting someone else. As the Gun Disabling Mock Ammunition can be made to be virtually or absolutely visually undetectable—The Gun Disabling Mock Ammunition will disable a stolen gun when the criminal attempts to use it.

While gun-disabling sabotage ammunition is not new, what is unique about the Gun Disabling Mock Ammunition is that it is not able to injure any people and accomplishes this through the use of non-hazardous and commercially available incendiary components. There is no opportunity for individuals to gain access to restricted or illicit materials by dissecting a Gun Disabling Mock Ammunition.

The non-hazardous and subtle nature of the Gun Disabling Mock Ammunitions functionality allows for its use in any domestic civilian environment, by law enforcement for protecting themselves from their own guns and for targeted reduction of gun crime in specific communities, while also having a useful function through military utilization in the battlefield. When someone attempts to fire a Gun Disabling Mock Ammunition, the result is a slight discharge of smoke from the ejection port and barrel of the firearm, the immediate blockage of the barrel and immediate destruction of the chamber of the firearm; there is no loud noise, no shockwave, no projectile, and no violent heat discharge capable of injuring the user.

DETAILED DESCRIPTION OF THE INVENTION

In the following description, reference is made to the accompanying drawings, which form a part hereof and which illustrate a preferred embodiment of the Gun Disabling Mock Ammunition according to the disclosure herein. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
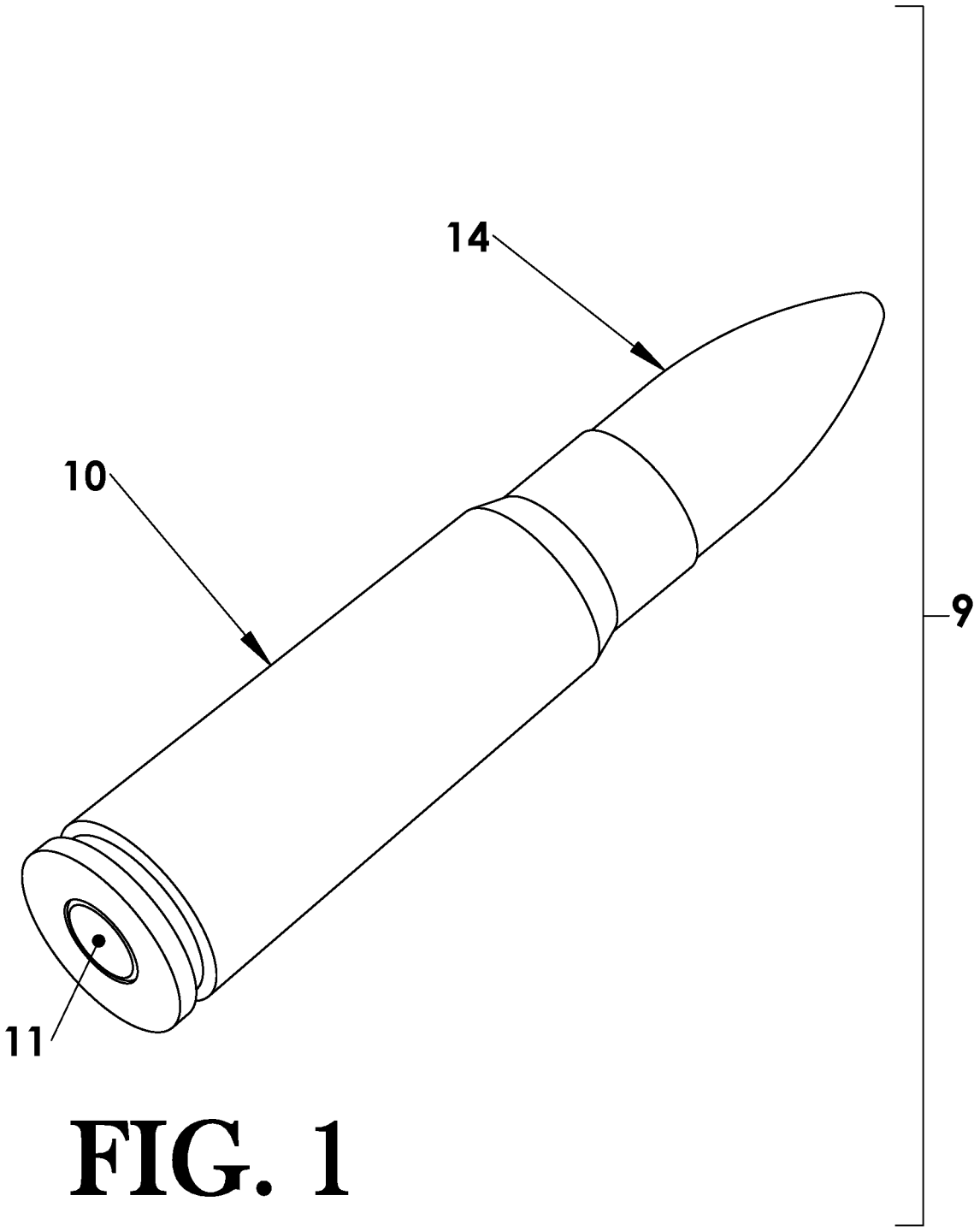
FIG. 1 shows an exterior perspective view of the preferred embodiment of the assembled Gun Disabling Mock Ammunition; in the form of an exemplary 7.62×39 mm ammunition cartridge.

A Gun Disabling Mock Ammunition (9), shown in FIG. 1, is configured to have the exact same outside dimensions, weight, and outward appearance as that of a common centerfire ammunition cartridge of a given caliber firearm. The Gun Disabling Mock Ammunition (9) may be configured to mimic the appearance and weight of any particular ammunition cartridge.

FIG. 1 shows the outward components of the Gun Disabling Mock Ammunition (9) as assembled. These components include the standard center-fire percussion primer cap (11), the Modified Shell Casing (10), and the modified Mock Bullet Projectile (14). These components are manufactured and assembled in generally the same way and with the same tools as traditional firearm ammunition.

Figure 2:
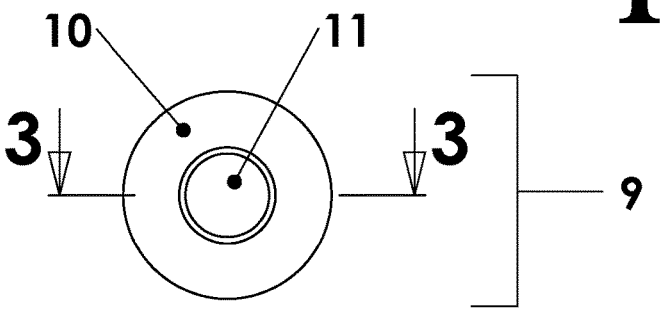
FIG. 2 is a view normal to the base of the Gun Disabling Mock Ammunition.

FIG. 2 is a view of the base of the Gun Disabling Mock Ammunition (9), showing the installed standard primer cap (11) being concentrically located and press-fit within the base of the Modified Shell Casing (10).

Figure 3:
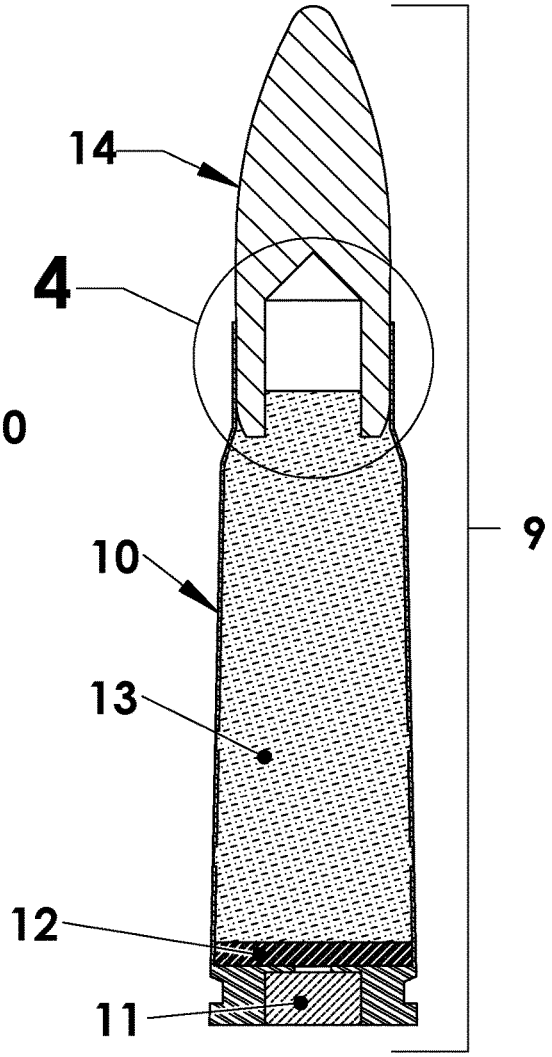
FIG. 3 is a sectional elevation view of the Gun Disabling Mock Ammunition shown in FIG. 2.

FIG. 3 is a section view of the Gun Disabling Mock Ammunition (9) in shown in FIG. 2. FIG. 3 shows the arrangement of components as being the same press-fit primer cap (11) as seen in FIG. 2 being concentrically located at the base of the Modified Shell Casing (10). Directly above the primer cap and flash-hole and within the cavity of the Modified Shell Casing (10) is the Ignition Mix (12) in a quantity large enough to be ignited by the discharge of the primer cap (11) and also large enough to ensure the ignition of the Thermite Mixture (13). The Thermite Mixture (13) is located above, and in direct contact with, the Ignition Mix (12). The Thermite (13) is contained within the cavity of the Modified Shell Casing (10) and below the installed Mock Bullet Projectile (14).

FIG. 3 also shows the cavity of the Modified Shell Casing (10) being closed-off by the press-fit installation of the Mock Bullet Projectile (14) into the end of the Modified Shell Casing (10) opposite the base.

Figure 4:
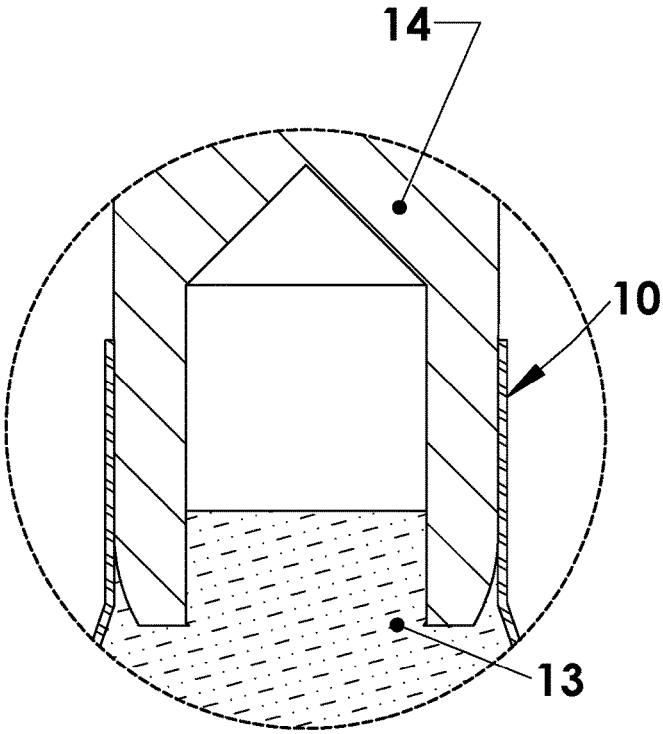
FIG. 4 is a detail view of a section of the Gun Disabling Mock Ammunition shown in FIG. 3 wherein the location of material removed for weight compensation is shown.

FIG. 4 is a detail view of the section of the Gun Disabling Mock Ammunition (9) shown in FIG. 3 where it is shown that material is removed from the Mock Bullet Projectile (14) to correct for weight discrepancies between the Gun Disabling Mock Ammunition (9) and actual ammunition.

Figure 5:
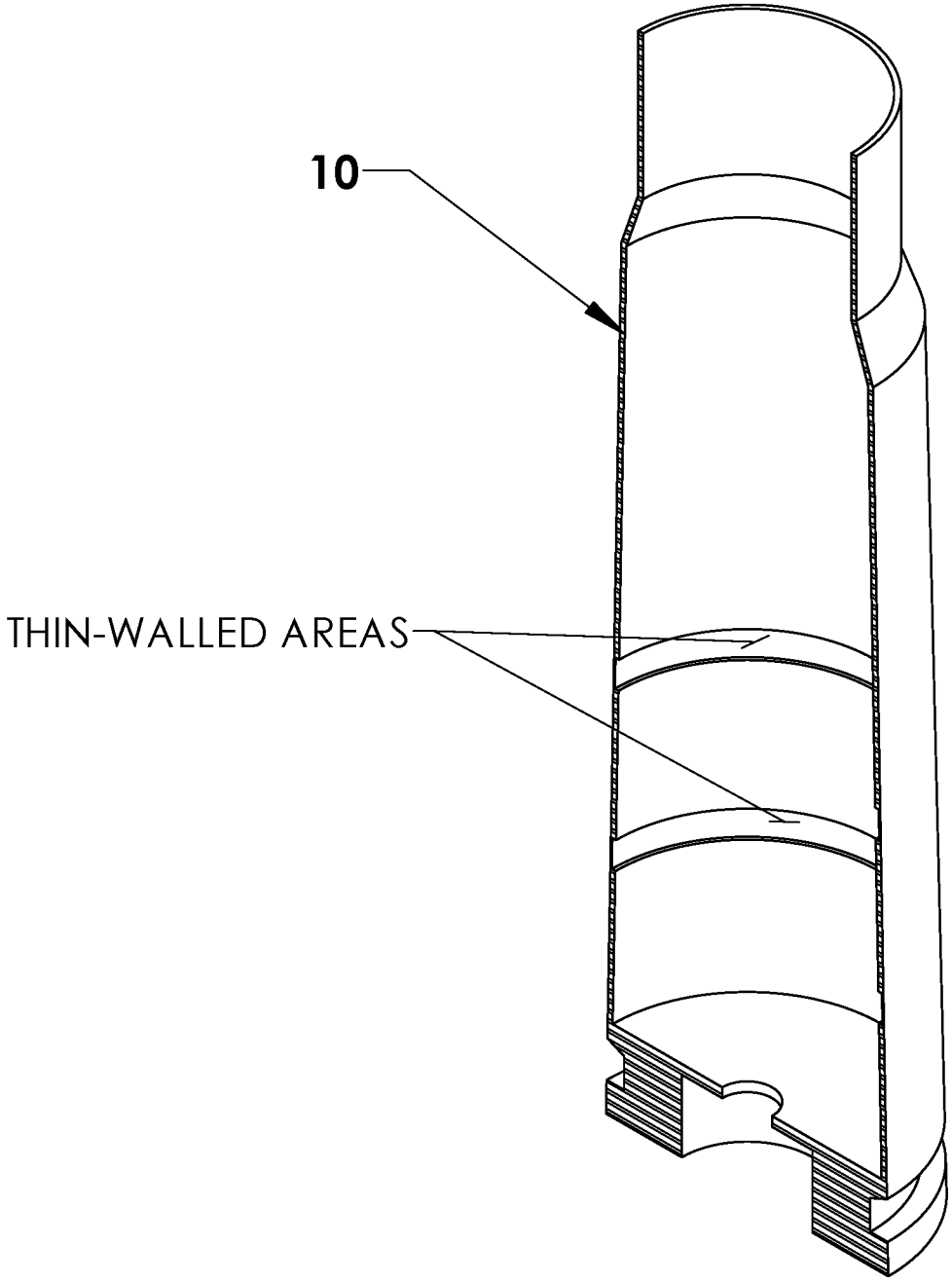
FIG. 5 is an isometric section view of the Modified Shell Casing, wherein an example of intentionally thin-walled areas is shown.

FIG. 5 is a cross-section, perspective view of the Modified Shell Casing (10) in which the areas noted to be "thin-walled" have had material removed from the inside surface of the Modified Shell Casing (10) walls. The presence, location, surface area, and thickness of these intentionally thin areas can vary depending on the space restrictions presented by different caliber ammunition.

I claim:

1. A gun disabling mock ammunition cartridge, comprising:

i) a casing defining an interior;

ii) a first quantity contained in the interior, the first quantity consisting of a first thermite powder; and iii) a second quantity contained in the interior, the second quantity consisting of an ignition mixture for the first quantity, the ignition mixture comprising a second thermite powder that is finer than the first thermite powder.

2. The gun disabling mock ammunition cartridge of claim 1, further comprising: a percussion primer cap, wherein the second thermite powder is more susceptible to ignition by detonation of the percussion primer cap than the first thermite powder.

3. The gun disabling mock ammunition cartridge of claim 2, wherein the second quantity is ignitable by the detonation to form an ignited second quantity.

4. The gun disabling mock ammunition cartridge of claim 3, wherein the first quantity is ignitable by the ignited second quantity to form an ignited first quantity.

5. The gun disabling mock ammunition cartridge of claim 4, wherein the ignited first quantity melts the casing to form melted casing.

6. The gun disabling mock ammunition cartridge of claim 5, wherein the melted casing bonds to a chamber of a firearm into which the gun disabling mock ammunition cartridge has been inserted.

7. The gun disabling mock ammunition cartridge of claim 6, wherein the second quantity is located between the percussion primer cap and the first quantity in the casing.

8. The gun disabling mock ammunition cartridge or claim 1, wherein a fuel-to-metal oxide ratio of the first thermite powder is different from a fuel-to-metal oxide ratio of the second thermite powder.

9. The gun disabling mock ammunition cartridge of claim 1, wherein the first thermite powder comprises Aluminum, a plurality of Iron Oxides, and a plurality of Copper Oxides.

10. The gun disabling mock ammunition cartridge of claim 9, wherein the second thermite powder comprises Aluminum, an Iron Oxide, and a Copper Oxide.

11. The gun disabling mock ammunition cartridge of claim 1, further comprising: a projectile, wherein the projectile has a cavity.

12. The gun disabling mock ammunition cartridge of claim 1, wherein a weight and a geometry of the gun disabling mock ammunition cartridge matches a weight and a geometry of a predetermined cartridge for a predetermined firearm.

13. The gun disabling mock ammunition cartridge of claim 1, wherein the ignition mixture further comprises a binder.

14. A gun disabling mock ammunition cartridge, comprising:

i) a casing defining an interior;

ii) a percussion primer cap configured to detonate when struck by a firing pin of a firearm into which the gun disabling mock ammunition cartridge has been loaded;

iii) a first quantity contained in the interior, the first quantity selected to ignite to form an ignited first quantity that non-explosively damages internal components of the firearm, the first quantity consisting of a first thermite powder; and iv) a second quantity contained in the interior, the second quantity selected to form an ignition mixture for the first quantity, the ignition mixture comprising a second thermite powder that is finer than the first thermite powder.

15. The gun disabling mock ammunition cartridge of claim 14, wherein the non-explosively damaged internal components render the firearm inoperable.

16. The gun disabling mock ammunition cartridge of claim 14, further comprising: a casing, wherein the casing is melted by the ignited first quantity to form a melted casing that bonds to a chamber of the firearm.

17. The gun disabling mock ammunition cartridge of claim 16, wherein the melted casing forms a blockage in the chamber.

18. The gun disabling mock ammunition cartridge of claim 17, wherein the casing further comprises one or both of an outward color and a printed graphic.

19. The gun disabling mock ammunition cartridge of claim 16, further comprising: a projectile, wherein the projectile remains inside the firearm following the damage to the internal components of the firearm.

20. The gun disabling mock ammunition cartridge of claim 14, wherein a color of the percussion cap primer does not match a color of a predetermined ammunition cartridge.

* * * * *